US007796936B2

(12) United States Patent
Carter et al.

(10) Patent No.: US 7,796,936 B2
(45) Date of Patent: Sep. 14, 2010

(54) IMAGE FORMING DEVICE WITH MULTIMODE DUPLEXER

(75) Inventors: Daniel L. Carter, Georgetown, KY (US); William Paul Cook, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/532,931

(22) Filed: Sep. 19, 2006

(65) Prior Publication Data

US 2007/0014610 A1 Jan. 18, 2007

Related U.S. Application Data

(62) Division of application No. 10/811,172, filed on Mar. 26, 2004, now Pat. No. 7,130,574.

(51) Int. Cl.
*G03G 15/00* (2006.01)

(52) U.S. Cl. ..... 399/401; 101/230

(58) Field of Classification Search ..... 399/401, 399/402; 271/902; 101/229, 230, 231, 232
See application file for complete search history.

(56) References Cited

U.S. PATENT DOCUMENTS 4,488,801 A 12/1984 Gibson
4,918,490 A 4/1990 Stemmle
4,990,965 A 2/1991 Kiya
5,095,342 A 3/1992 Farrell et al.
5,095,371 A 3/1992 Tanaka et al.
5,132,719 A 7/1992 Kioka et al.
5,159,395 A 10/1992 Farrell et al.
5,184,185 A 2/1993 Rasmussen et al.
5,504,568 A 4/1996 Saraswat et al.
5,703,693 A 12/1997 Morikawa
5,729,790 A 3/1998 Conley et al.
5,812,273 A 9/1998 Conley et al.
5,930,577 A 7/1999 Forsthoefel et al.
6,064,840 A 5/2000 Hubler
6,069,704 A 5/2000 Verhaag
6,097,500 A 8/2000 Fromherz
6,411,795 B2 6/2002 Okamoto
6,539,198 B2 3/2003 Miyajima
2002/0061215 A1* 5/2002 Kamei ..... 399/401

OTHER PUBLICATIONS

US 2001/0028819; Okamoto; Image Forming Apparatus; Oct. 11, 2001.

* cited by examiner

*Primary Examiner*—Ren Yan

(57) ABSTRACT

An image forming device in a color printer or the like includes duplex printing. Multiple media sheets are moved through a media path which includes a primary path and a duplex path. Various parameters of the image forming device control the interpage gap between sheets. Parameters include peek-a-boo duplexing, sharing of motors within the drive rollers, and sharing of power supplies.

19 Claims, 8 Drawing Sheets

IMAGE FORMING DEVICE WITH MULTIMODE DUPLEXER

RELATED APPLICATION

The present application is a divisional application of U.S. patent application Ser. No. 10/811,172 filed on Mar. 26, 2004 now U.S. Pat. No. 7,130,574.

BACKGROUND

The invention relates generally to an image forming device, and more particularly, to an image forming device having a multimode duplexer.

An image forming device, such as a color printer, typically includes four units associated with four colors, black, magenta, cyan and yellow. Each unit includes a laser printhead that is scanned to provide a latent image on the charged surface of a photoconductive unit. The latent image on each unit is developed with the appropriate color toner and is then transferred to either an intermediate transfer medium or directly to a substrate (such as paper) that travels past the photosensitive units. The resulting full-color image is dependent on the combination of each color toner transferred to the substrate one line at a time. The toner on the substrate is then fused to the substrate in a fuser assembly, and the substrate is transported out of the printer. Thus, in a typical multi-color laser printer, the substrate receives color images generated at each of the four image units.

An image forming device may form an image on one or both sides of the substrate. Two-sided printing is called duplex printing. For duplex printing, an image is formed on one side of the substrate and then the substrate is returned to the device for printing on the other side of the substrate.

The image forming device, like all consumer products, should be constructed in an economical manner. Price is one of the leading factors when a user makes a purchasing decision. Further, quality of the resulting product is another factor for users. Cost and quality are thus guiding factors in the design and manufacture of image forming devices.

SUMMARY

According to one aspect of the present invention, a method of duplex printing includes transferring print material to a first side of one media substrate after another media substrate has been partially expelled from the image forming device and moved into a duplex path of the image forming device. According to another aspect of the present invention, gaps between the media substrates are varied as the media substrates are moved through the image forming device.

DETAILED DESCRIPTION

Figure 1:
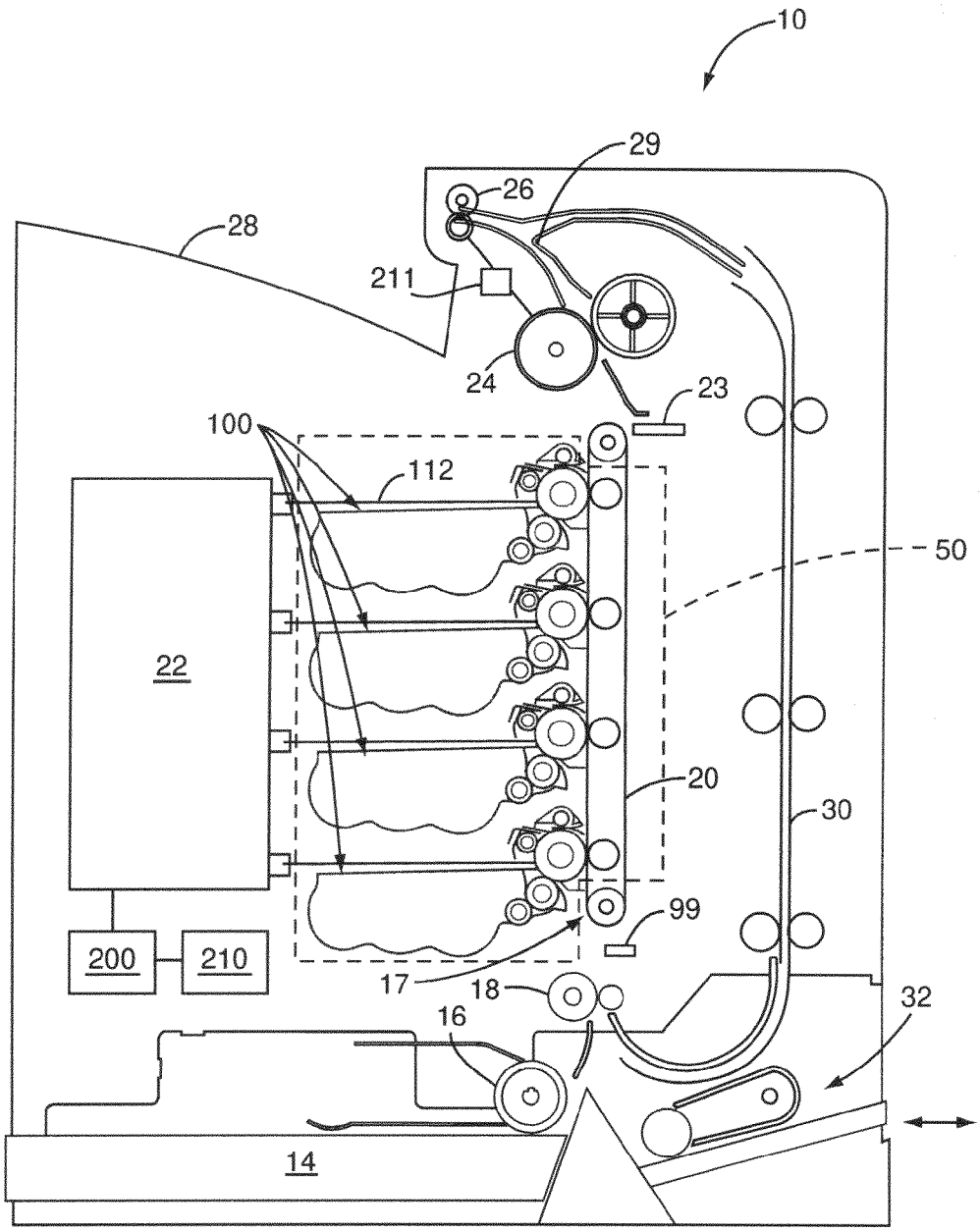
FIG. 1 is a schematic view of one embodiment of an image forming device constructed according to the present invention.

FIG. 1 depicts a representative image forming device 10. According to one embodiment of the present invention, the image forming device 10 is a color laser printer. Other examples of an image forming device include but are not limited to an ink-jet printer, fax machine, copier or any combination thereof However, it should be apparent to those skilled in the art that the image forming device 10 may be any device in which an image is formed on a media substrate. The image forming device 10 comprises a media tray 14 with a pick mechanism 16, or a manual input 32, for introducing media substrates in the device 10. The media tray 14 is preferably removable for refilling, and located on a lower section of the device 10.

Media substrates may comprise paper of any type, transparencies, labels, envelopes and the like. In one aspect of the present invention, sheets of paper are moved from the input and fed into a primary media path 17. One or more registration rollers 18 disposed along the primary media path 17 align the media and precisely control its further movement along the primary media path 17. A media transport belt 20 may form a section of the primary media path 17 for moving the media past an image transfer assembly 50. The image transfer assembly 50 includes a plurality of image forming units 100.

As illustrated in FIG. 1, the image forming device 10 includes four image forming units 100 for transferring print material on the media to produce a full-color image. The image forming units 1000 are disposed along a vertical plane. However, it will be appreciated by those skilled in the art that the image forming units may be disposed along a horizontal plane or any other orientation. The print material typically comprises toner of varying colors. For illustrative purposes, the image forming units 100 include cyan, magenta, yellow, and black toner to produce a full-color image on the media.

An imaging device 22 forms an electrical charge on a photoconductive unit 102 (see FIG. 2) within the image forming units 100 as part of the image formation process. The term "imaging device" refers to a device that arranges an electrical charge on the photoconductive unit 102. Various imaging devices may be used such as a laser printhead or a LED printhead.

The media continues moving along the media path 17 past a toner patch sensor or registration sensor 23. As is well known in the art, the toner patch sensor 23 determines the relative alignment of one toner layer to another. In one embodiment, sensor 23 includes an emitter that radiates a light beam on the toner layers and a receiver that detects sensing light reflected from the media. In one embodiment, the sensor 23 is aligned with the edge of the transport belt 20 and senses the toner layers while on the belt 20. In another embodiment, sensor 23 senses the toner layers on the media sheets. Additional sensors 99 may be positioned along the media path to detect the leading and trailing edges of the media sheets. This information is forwarded to a processor 200 which oversees the timing of the image formation process.

The media with loose toner from one or more of the image forming units 100 is then moved through a fuser 24 that adheres the toner to the media. Exit rollers 26 rotate in a forward or a reverse direction to move the media to an output tray 28 or a duplex path 30. When the media is output, exit rollers 26 rotate in a forward direction and the sheets are expelled into the output tray 28. For duplex printing, the exit rollers 26 rotate in a forward direction until the trailing edge moves beyond diverter 29. The exit rollers 26 reverse direction and drive the sheet into the duplex path 30. This duplexing scheme is referred to as "peek-a-boo duplexing" because a leading section of the media sheet is partially expelled from the device 10 until the exit rollers 26 reverse and pull it back into the device 10. The duplex path 30 directs the inverted sheet of media back through the image formation process for forming an image on a second side of the media.

In one embodiment of the present invention, a single motor 211 controls the exit rollers 26 and the fuser 24. The fuser 24 operates only in a forward direction and is disengaged when motor 211 reverses direction to move the media sheets into the duplex path 30. Once the media sheet has moved beyond the control of the exit rollers 26, the motor 211 is changed again to the forward direction and the fuser 24 is re-engaged in anticipation of the next media sheet. It will be apparent to those skilled in the art that the exit rollers 26 and the fuser 24 may be controlled by two motors and operate independent of each other.

Figure 2:
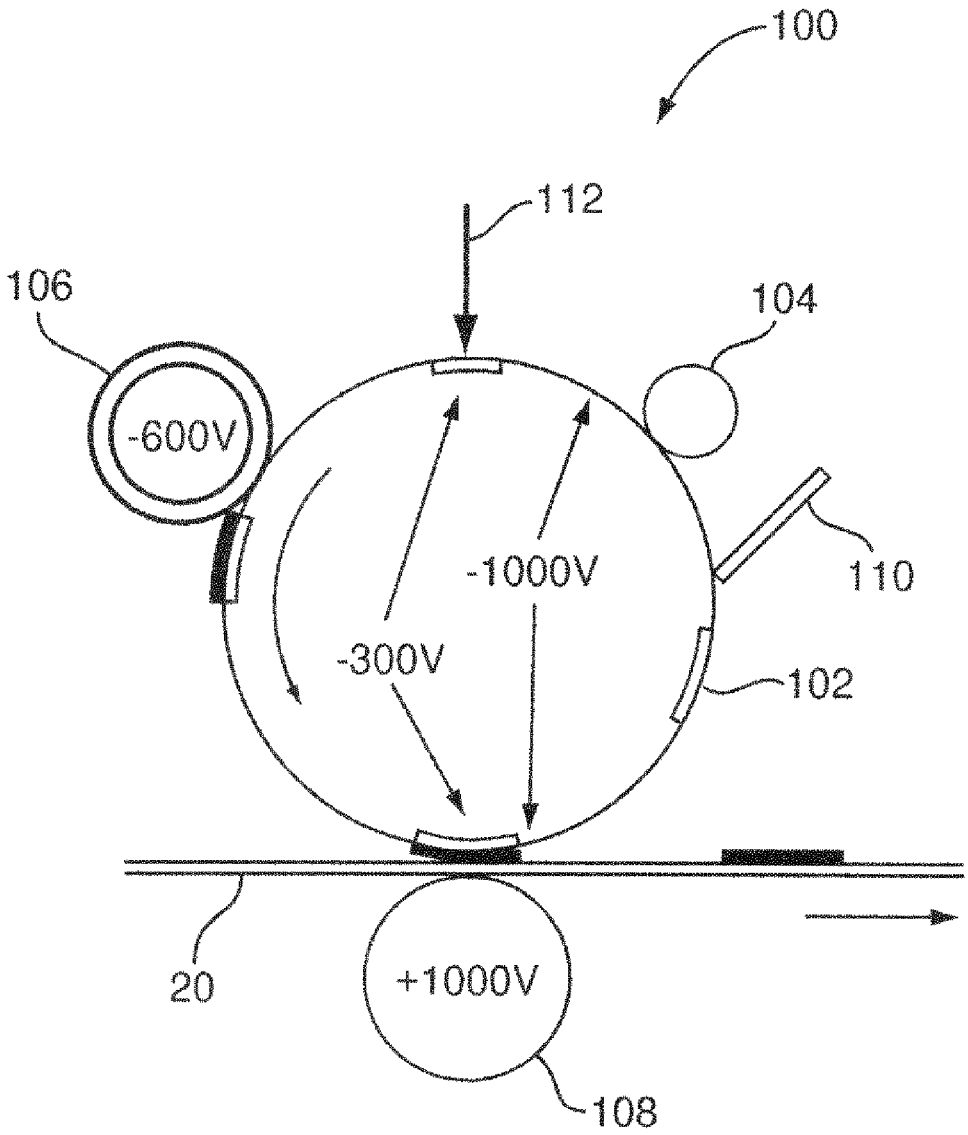
FIG. 2 is a schematic view illustrating an image forming unit of the image forming device of FIG. 1.

FIG. 2 is a schematic diagram illustrating a section of the image forming unit 100 including a photoconductive (PC) unit 102, a charging unit 104, a developer roll 106, a transfer device 108, and a cleaning blade 110. The PC unit 102 is cylindrically shaped and illustrated as a drum. However, it will be apparent to those skilled in the art that the PC unit 102 may comprise any appropriate structure. In one embodiment, PC unit 102 is an aluminum hollow-core drum coated with one or more layers of light-sensitive organic photoconductive materials. The charging unit 104 charges the surface of the PC unit 102 to a negative potential, approximately −1000 volts in the present embodiment A laser beam 112 from the imaging device 22 (see FIG. 1) discharges areas on the PC unit 102 to form a latent image on the surface of the PC unit 102. The areas of the PC unit 102 illuminated by the laser beam 112 are discharged resulting in a potential of approximately −300 volts in the present embodiment. The PC unit core is held at approximately −200 volts while the transfer device 108 is charged at a predetermined positive potential.

The potential of the transfer device 108 may vary depending on the type of media substrate, the color of the toner being applied to the media substrate and whether toner is being applied to the first or second side of the media substrate. The developer roll 106 transfers negatively-charged toner having a core voltage of approximately −600 volts to the surface of the PC unit 102 to develop the latent image on the PC unit 102. The toner is attracted to the most positive surface, i.e., the area discharged by the laser beam 112. As the PC unit 102 rotates, a positive voltage field produced by the transfer device 108 attracts and transfers the toner on the PC unit 102 to the media substrate. Alternatively, the toner images could be transferred to an intermediate transfer member (ITM) and subsequently from the ITM to the media substrate. Remaining toner on the PC unit 102 is then removed by the cleaning blade 110. The transfer device 108 may include a roll, a transfer corona, transfer belt, or multiple transfer devices, such as multiple transfer rolls. The area between the PC unit 102 and the transfer device 108 is known as a transfer nip.

Figure 3:
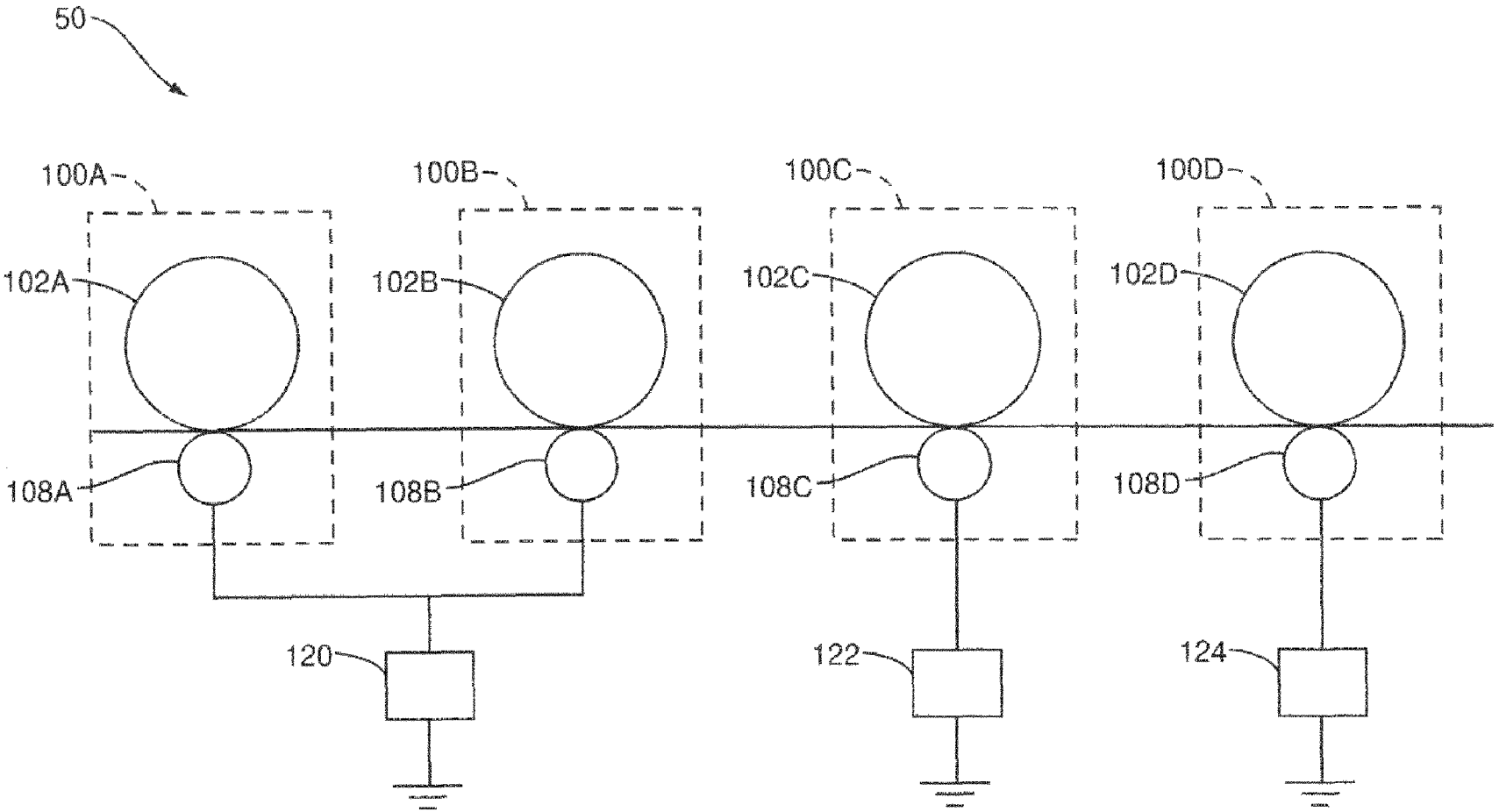
FIG. 3 is a block diagram of an image transfer assembly of the image forming device of FIG. 1.

Referring now to FIG. 3, the image transfer assembly 50 comprises four image forming units 100A-100D. In one embodiment of the present invention, the first image forming unit 100A contains black toner, the second image forming unit 100B contains yellow toner, the third image forming unit 100C contains magenta toner and the fourth image forming unit 100D contains cyan toner. However, it will be apparent to those skilled in the art that the location of the toner as well as the exact color of the toner may vary. Each image forming unit 100A-100D comprises corresponding PC units 102A-102D and transfer devices 108A-108D. A voltage is applied to the transfer devices 108A, 108B of the first and second image forming units 100A, 100B using a shared high voltage power supply 120. Similarly, a voltage is applied to the transfer device 108C of the third image forming unit 100C using a second high voltage power supply 122 and a voltage is applied to the transfer device 108D of the fourth image forming unit 100D using a third high voltage power supply 124. The details of the shared power supply is described in U.S. patent application Ser. No. 10/810,730 "Shared High Voltage Power Supplies for Image Transfer" which is filed concurrently herewith and incorporated herein by reference in its entirety.

Referring again to FIG. 1, the image forming device 10 includes a processor 200 and a memory 210. The processor 200 controls transferring a toner image onto the media, as well as movement of the media through the media path 17 and duplex path 30. Referring to FIG. 3, the process of transferring the image onto the media occurs sequentially starting at the first image forming unit 100A. The desired image is transferred to the media line-by-line as the above process is repeated for each image forming unit 100 to produce the desired color and image. The media is moved along a section of the primary media path 17 and to each image forming unit 100A-100D by the media transport belt 20. Accordingly, different layers of toner, starting with black and followed by yellow, magenta and cyan in the present embodiment, are added to the media to produce the desired color and image. As is well known in the art, the exact color produced on the media will depend on the toner transferred as well as the intensity thereof.

The transfer process is carried out by mechanically assisted electrostatic transfer. The toned image produced on each PC unit 102A-102D is transferred to the media by applying opposite polarity of charge on the media to that of the toner charge. The transfer devices 108A-108D provide the necessary transfer current to charge the media based in direct relation to the voltage potential established by the high voltage power supplies 120, 122, 124. The desired transfer current is dependent on a number of factors, such as temperature, relative humidity, media substrate type and the number of layers of toner applied to the media. The temperature and relative humidity may be determined by an appropriate sensor as is well known in the art. The desired transfer current is provided by changing the voltage applied to each of the transfer devices 108A-108D. The voltage applied to each transfer device 108A-108D by the high voltage power supplies 120, 122, 124 is determined by transfer voltage tables as is well known in the art.

The processor 200 includes logic circuitry to control the operation of the image forming device 10 according to program instructions stored in memory 210. The processor 200 may comprise, for example, a single microcontroller or microprocessor. Alternatively, two or more such devices may implement the functions of the processor 200. The processor 200 may be incorporated within a custom integrated circuit or application specific integrated circuit (ASIC). The memory 210 may be incorporated into the processor 200, or may comprise a discrete memory device, such as random access memory (RAM), read only memory (ROM), electrically erasable programmable read only memory (EEPROM), and FLASH memory. The memory 210 may be part of the same ASIC as the processor 200.

The image forming device 10 may operate in simplex or duplex mode. In simplex mode, toner images are transferred to one side of the media sheet. In duplex mode, after an image is applied to one side of the media, the media is partially ejected from the image forming device 10 and fed into the duplex path 30. The inverted media is fed back to the primary media path 17 and the second image is transferred to the other side of the media. The processor 200 also controls how the image is applied to the media so that it is properly aligned on the media.

For illustrative purposes, operation of one embodiment of the image forming device 10 will be described for a 20 image, 10 page job. The run order is referred to by the sides of a page that are imaged, with a first sheet having side 1 and side 2, a second sheet having sides 3 and 4, a third sheet having sides 5 and 6, etc. In the described embodiment, the run order for the images is 2-4-1-3-6-8-5-7-10-12-9-11-14-16-13-15-18-20-17-19. The processor 200 is programmed to vary the print gaps as the media sheets are moved through the image forming device 10. The print gaps are selected so that the media sheets move continually through the image forming device 10. The gaps are also as small as possible to increase the device throughput.

Figure 4B:
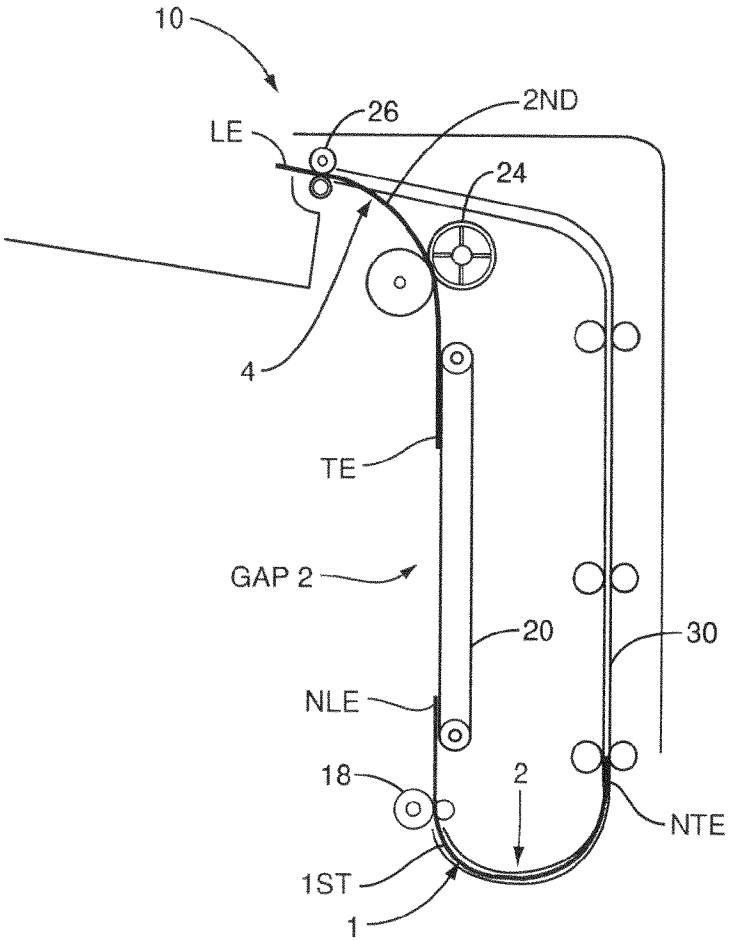
FIGS. 4A-4D are schematic views of one embodiment of the imaging process according to the present invention.
Figure 4A:
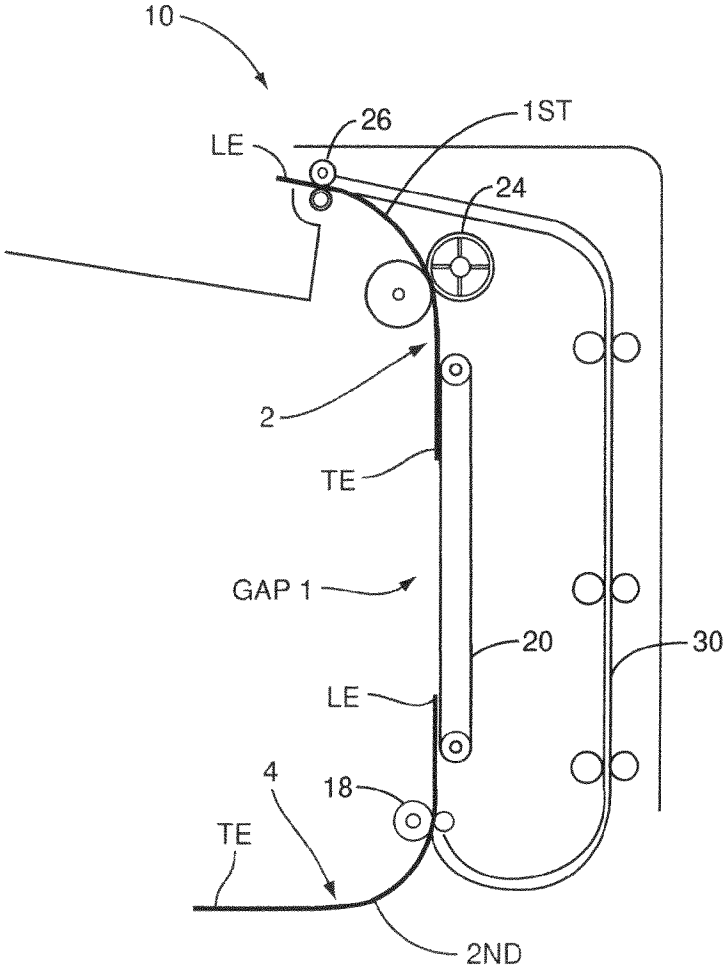

As shown in FIG. 4A, the gap between images 2 and 4, which is the gap between the trailing edge (TE) of the first page ($1^{st}$) and the leading edge (LE) of the second page ($2^{nd}$), is gap 1. After image 2 is transferred to the first page, it is partially ejected from the image forming device 10. The exit rollers 26 reverse direction and the first page is fed into the duplex path 30. Gap 1 is determined by the time for the first page to clear the exit rollers 26 into the duplex path and the fuser 24 to come up to speed after the motor reverses direction. It will be apparent to those skilled in the art that gap 1 may be reduced if two motors are used to control the exit rollers 26 and fuser 24 as the fuser 24 will be maintained at proper fusing speed.

As shown in FIG. 4B, the gap between images 4 and 1, which is the gap between the trailing edge of the second page and the new leading edge (NLE) after inversion of the first page, is gap 2. The previous leading edge is now the new trailing edge (NTE) after the media sheet is inverted in the duplex path 30. Gap 2 is determined by the greater of: the time for the second page to clear the exit rollers 26 into the duplex path and the fuser to come up to speed; or the time to get the first page through the duplexer path 30. The first constraint is caused by the fuser 24 stopping as the second sheet is reversed into the duplex path 30. After the new trailing edge of the second sheet clears the exit rollers 26 into the duplex path, the fuser 24 is brought back up to speed before the first sheet reaches the input nip. Gap 2 thus may be equal to gap 1.

Figure 4D:
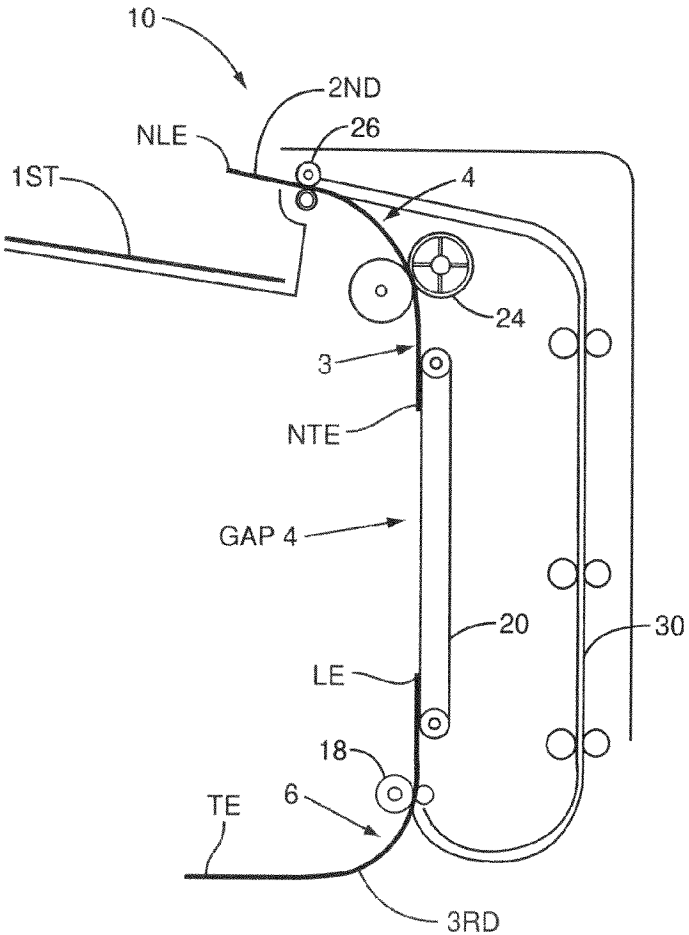
Figure 4C:
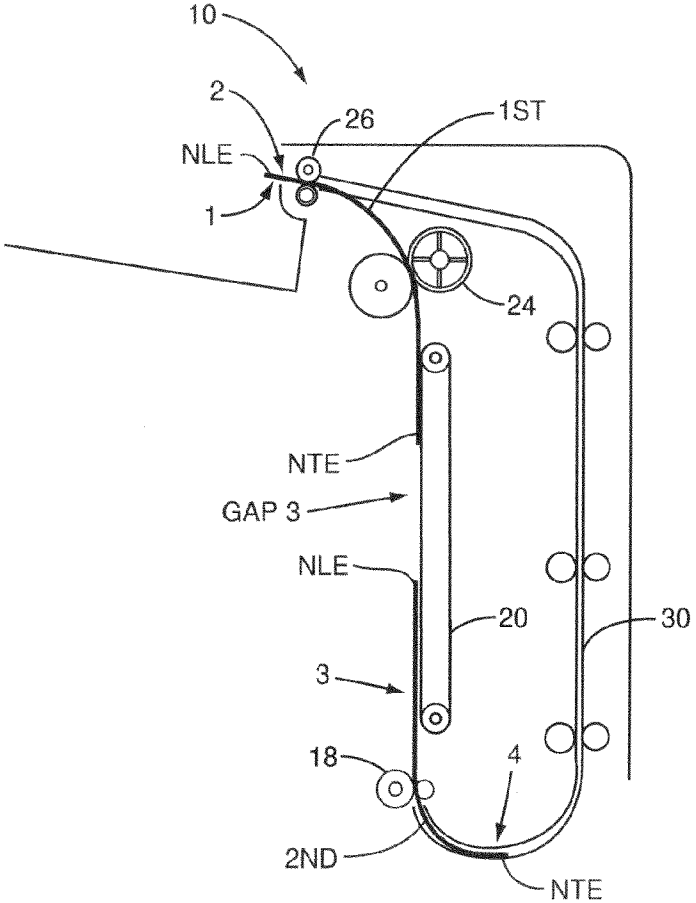

As shown in FIG. 4C, the gap between image 1 and 3, which is the gap between the new trailing edge of the first page and new leading edge of the second page, is gap 3. Gap 3 is the time it takes for the second page to exit the duplex path. Gap 3 may thus be less than gap 1 and gap 2.

As shown in FIG. 4D, the gap between image 3 and 6, which is the gap between the new trailing edge of the second page and the leading edge of the third page ($3^{rd}$), is gap 4. Gap 4 is the time it takes to switch the voltage of the shared high voltage power supply from a two-sided sheet voltage to a single-sided sheet voltage. The voltage shift is necessary in light of the shared high voltage power supply. It will be apparent to those skilled in the art that the switch would not be necessary if separate power supplies were used for each of the image forming units 100A-100D such that gap 4 could be reduced.

The overall minimum distance for each of the gaps in the process is the minimum distance for toner patch sensing. If toner patch sensing is not needed, the minimum gap is caused by the sensor 99 along the media path that detects the leading and trailing edge of the media sheets.

The process now repeats itself for the remaining images. Accordingly, the progression for the 10 page job is image 2, gap 1, image 4, gap 2, image 1, gap 3, image 3, gap 4, image 6, gap 1, image 8, gap 2, image 5, gap 3, image 7, gap 4, image 10, gap 1, image 12, gap 2, image 9, gap 3, image 11, gap 4, image 14, gap 1, image 16, gap 2, image 13, gap 3, image 15, gap 4, image 18, gap 1, image 20, gap 2, image 17, gap 3, image 19. Thus, in the 10 page illustrative example, the gap sequence repeats itself five times. It will be apparent that in one aspect of the present invention, there are two sheets of media in the image device 10 during image transfer, e.g., one sheet in the duplex path 30 and another sheet in the primary media path 17.

FIGS. 5A-5D illustrate another method of moving media sheets along the media path. This embodiment features a ten page-three image job with a run order of 2-4-1-6-3-8-5-10-7-12-9-14-11-16-13-18'-15-20'-17-19. The processor 200 determines the varying print gaps as the media sheets move through the image forming device 10.

Figure 5B:
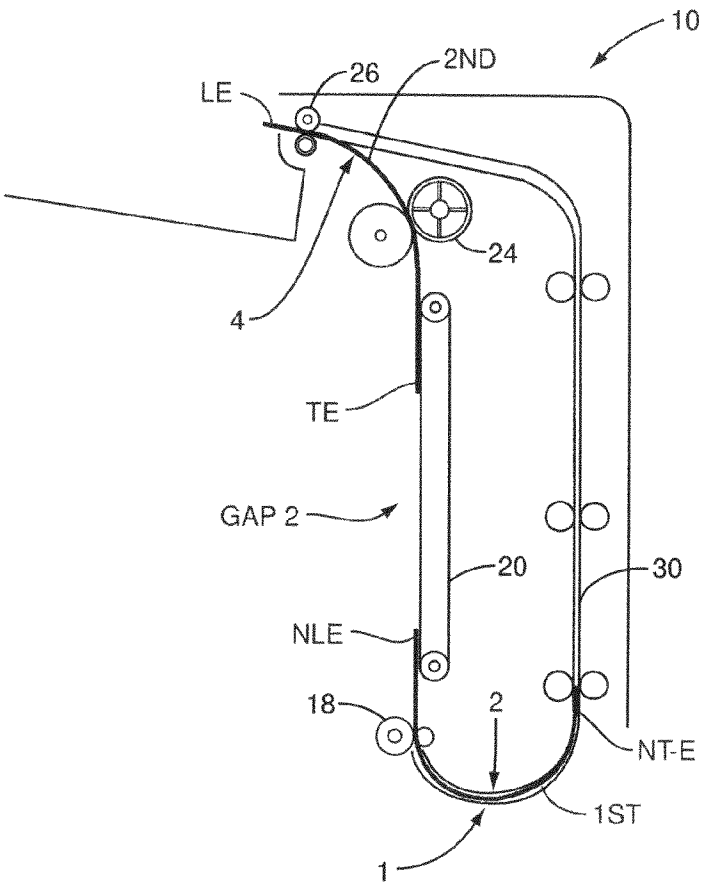
FIGS. 5A-5F are schematic views of another embodiment of the imaging process according to the present invention.
Figure 5A:
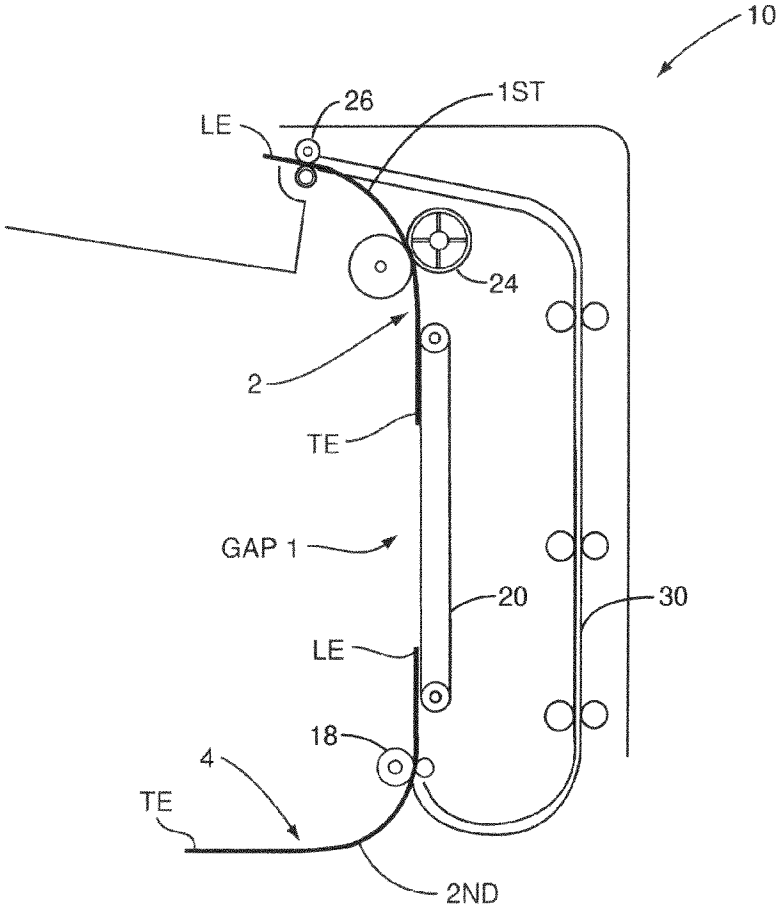

As illustrated in FIG. 5A, the gap between images 2 and 4 is gap 1 and defined by the trailing edge (TE) of the first page ($1^{st}$) and the leading edge (LE) of the second page ($2^{nd}$) After image 2 is transferred to the first page it is partially ejected from the device 10. The exit rollers 26 reverse direction and the first page is fed into the duplex path 30. Gap 1 is the time for the first page to clear the exit rollers 26 and for the fuser 24 to come up to speed after the motor reverses direction. Gap 1 may be reduced if separate motors control the fuser 24 and exit rollers 26.

FIG. 5B illustrates gap 2 between images 4 and 1 defined by the trailing edge of the second sheet and the new leading edge (NLE) of the first sheet after it has been inverted in the duplex path 30. Gap 2 is the greater of: gap 1; and the time to get the first page through the duplex path 30. Gap 2 may be equal to gap 1.

Figure 5D:
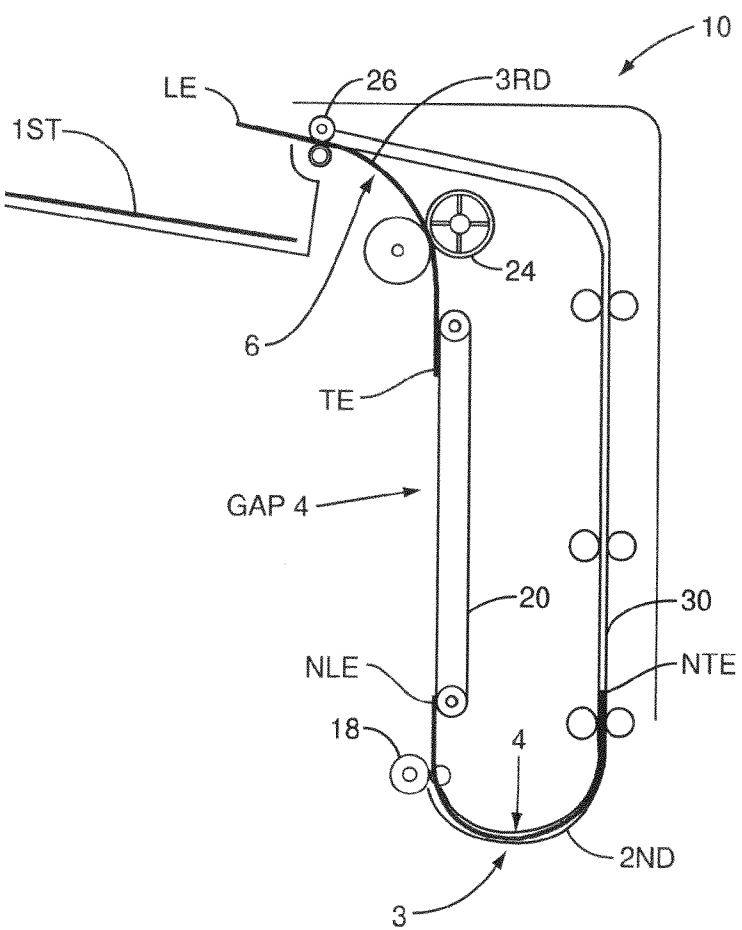
Figure 5C:
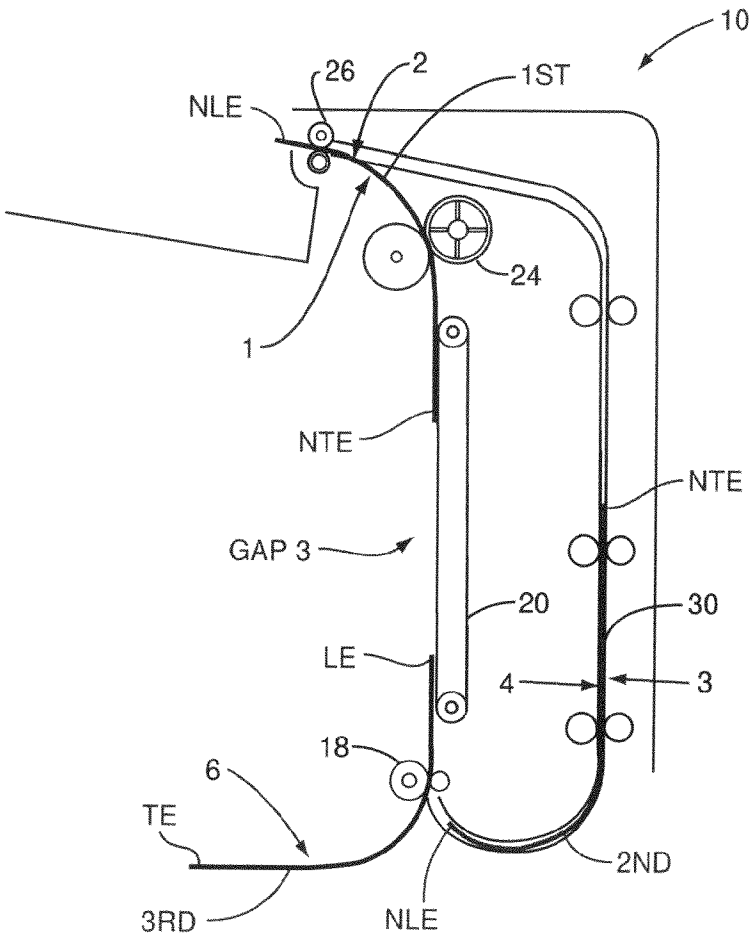

FIG. 5C illustrates gap 3 between images 1 and 6 defined by the new trailing edge of the first sheet and the leading edge of a third sheet. The second sheet is stopped in the duplex path 30 until the third sheet clears. Gap 3 is the time necessary to switch the voltage of the shared high voltage power supply from a two-sided sheet voltage to a single-sided voltage. The voltage shift is necessary in light of the shared high voltage power supply. If there was no shared power supply, the gap could be reduced. In one embodiment, gap 3 is the same as gap 4 in the previously-defined 2-image sequence.

FIG. 5D illustrates gap 4 between images 6 and 3 defined by the trailing edge of the third sheet and the new leading edge of the second sheet. Gap 4 is the time for the third page to clear the exit rollers 26 into the duplex path 30 and for the fuser 24 to come up to speed after the motor reverses direction. Gap 4 may be reduced if separate motors control the fuser 24 and exit rollers 26. Gap 4 timing and distance may be the same described for gap 2 above.

Figure 5F:
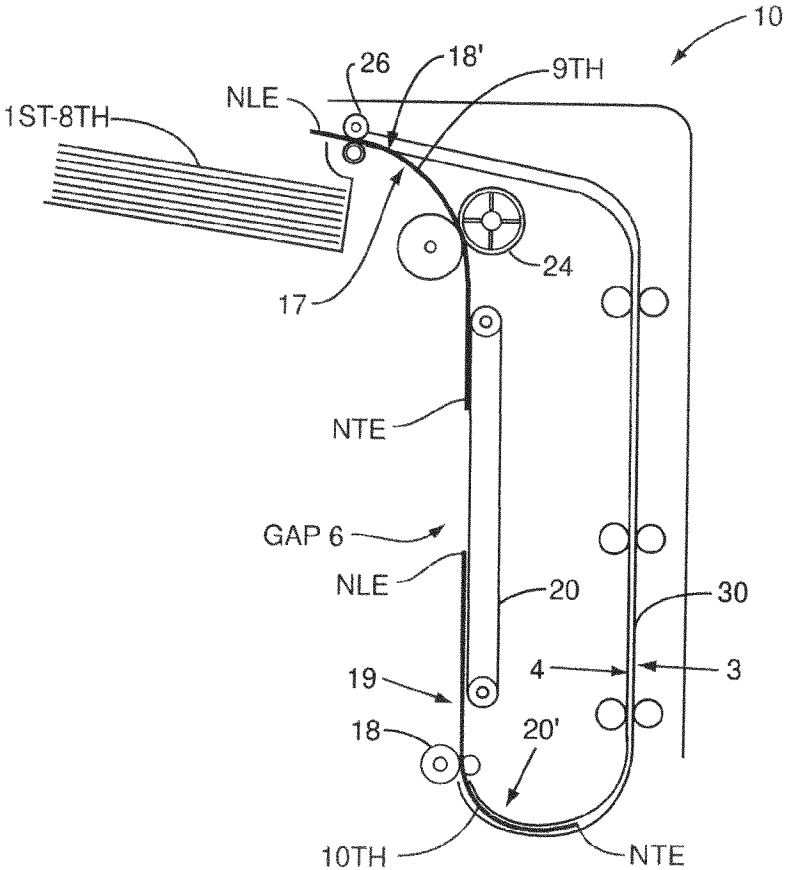
Figure 5E:
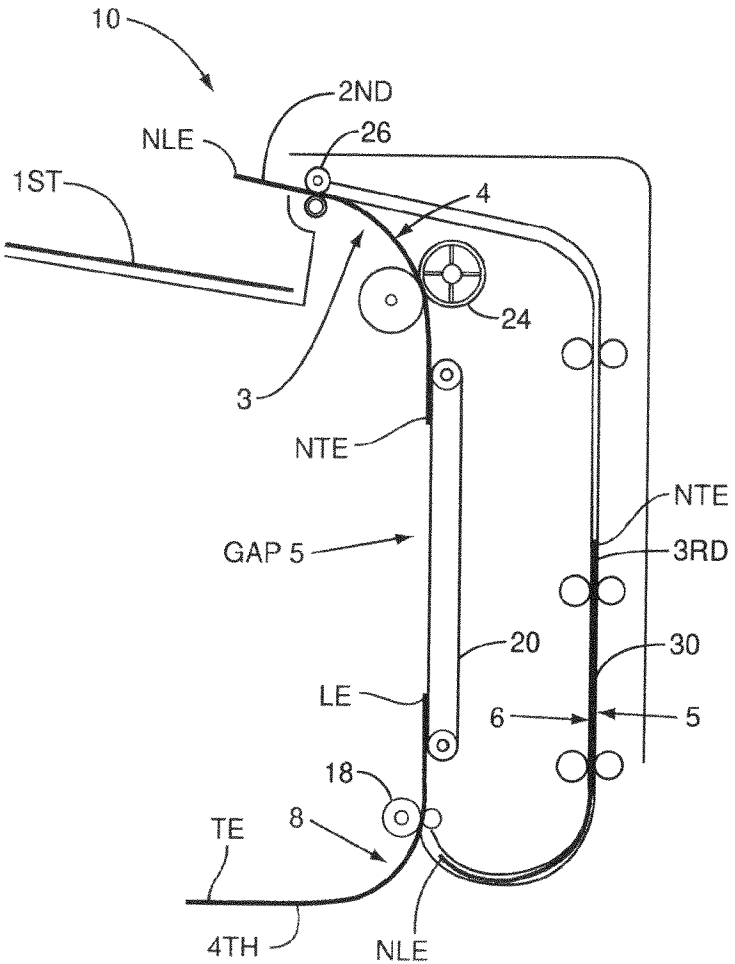

FIG. 5E illustrates gap 5 between images 3 and 8 defined by the new trailing edge of the second sheet and the leading edge of the fourth sheet. Gap 5 timing and distance may be the same described for gap 3 above.

The sequence continues until the last two sides remain within the device as illustrated in FIG. 5F. Gap 6 is defined between images 17 and 19 and is defined between the new trailing edge of the ninth sheet and the new leading edge of the tenth sheet. Gap 6 is the time it takes for the tenth page to exit the duplex path. In one embodiment, gap 6 is the same as gap 3 in the previously-defined 2-image sequence.

Accordingly, the progression of this 10 page job is image 2, gap 1, image 4, gap 2, image 1, gap 3, image 6, gap 4, image 3, gap 5, image 8, gap 2, image 5, gap 3, image 10, gap 2, image 7, gap 3, image 12, gap 2, image 9, gap 3, image 14, gap 2, image 11, gap 3, image 16, gap 2, image 13, gap 3, image 18', gap 2, image 15, gap 3, image 20', gap 2, image 17, gap 6, image 19.

For each of the gaps in this embodiment, the overall minimum gap is the minimum distance for the toner patch sensor 23. If there is no toner patch sensor, the minimum gap is the distance necessary for the sensor 99 to detect the trailing and leading edges of the media sheets.

In one aspect of the present invention, the imaging process is controlled by the processor 200. It will be appreciated that, in general, the imaging process, may be implemented in one or more electronic circuits, such as in one or more discrete electronic components, one or more integrated circuits (ICs) and/or one or more application specific integrated circuits (ASICs), as well as by computer program instructions which may be executed by a computer or other data processing apparatus, such as a microprocessor or digital signal processor (DSP), to produce a machine such that the instructions which execute on the computer or other programmable data processing apparatus create electronic circuits or other means that implement the operations specified in the imaging process. The computer program instructions may also be executed on a computer or other data processing apparatus to cause a series of operations to be performed on the computer or other programmable apparatus to produce a computer implemented process such that the instructions which execute on the computer or other programmable apparatus provide operations for implementing the operation specified in the imaging process.

The computer program instructions may also be embodied in the form of a computer program product in a computer-readable storage medium, i.e., as computer-readable program code embodied in the medium for use by or in connection with an instruction execution system. The computer-readable storage medium may include, but is not limited to, electronic, magnetic, optical or other storage media, such as a magnetic or optical disk or an integrated circuit memory device. For example, the computer program instructions may be embodied in memory 210 included in the image forming device 10 and/or apparatus and/or storage medium operable to program such memory. Accordingly, the imaging process in FIGS. 4A-4D and FIGS. 5A-5F support electronic circuits and other means that perform the specified operations, acts for performing the specified operations, and computer program products configured to perform the specified operations.

The transport belt 20 is illustrated in the embodiments for moving the media sheets past the image forming units 100. In another embodiment, roller pairs are spaced along the media path to move the media sheets past the image forming units 100.

In one embodiment, the media sheet is moved through a section of the duplex path 30 at a faster speed than the main media path. As the media sheet enters the duplex path 30, the sheet moves at a faster speed. The media sheet is then slowed by the time it reaches the main media path (such as nip 18 illustrated in FIG. 1) such that the duplex speed is about equal to the process speed when the media sheet moves from the duplex path 30 back into the main media path for imaging on a second side. In one embodiment, a single motor operates each of the rolls along the duplex path 30. In this embodiment, a first sheet moving at about process speed exits the last duplex roll of the duplex path 30, the motor then accelerates to a higher speed to receive the next sheet that enters first duplex roll of the duplex path 30 from the exit rolls 26.

The present invention may be carried out in other specific ways than those herein set forth without departing from the scope and essential characteristics of the invention. In one embodiment, the duplex mode features the media sheet initially moving along the primary media path 17 without receiving a toner image. The media sheet is duplexed through the duplex path 30, and a toner image is applied during the second pass through the primary media path 17. The spacing for these types of media sheets follow the pattern established for a sheet receiving a toner image on both sides. The present embodiments are, therefore, to be considered in all respects as illustrative and not restrictive, and all changes coming within the meaning and equivalency range of the appended claims are intended to be embraced therein.

What is claimed is:

1. A method of transferring ordered images to respective sides of a first media substrate and a second media substrate in a duplex image forming device in which said media substrates are partially expelled from an image forming device, said order of images comprising a first image, a second image, a third image and a fourth image, said method comprising:

transferring said second image to a first side of said first media substrate;

transferring said fourth image to a first side of said second media substrate;

transferring said first image to a second side of said first media substrate;

transferring said third image to a second side of said second media substrate;

wherein a first interpage gap extends between the second image and the fourth image, a second interpage gap extends between the fourth image and the first image, and a third interpage gap extends between the first image and the third image, with each of the interpage gaps being different;

transferring a fifth image to a third media substrate following transferring the third image to the second side of the second media substrate; and varying the gaps between said media substrates as said media substrates are moved through the image forming device, the first, second, third, fourth, and fifth images being part of a single print job.

2. The method of claim 1, wherein at least two gaps between successive substrates upon which images are transferred are different from each other.

3. A method of a transferring print material on each side of a plurality of media substrates using a duplex image forming device, said method comprising:

varying gaps between said media substrates as said media substrates are moved through said image forming device so that at least two gaps between successive media substrates upon which print material are transferred are different from each other, wherein varying gaps between said media substrates as said media substrates are moved through said image forming device comprises varying a first gap and a second gap between a first media substrate and a second media substrate, said first gap being a distance between a trailing edge of said first media substrate and a leading edge of said second media substrate, said second gap being a distance between a trailing end of said second media substrate and a new leading edge of said first media substrate, the first gap is based upon the combined time necessary for a media substrate to clear exit rollers and enter a duplex path of the duplex image forming device and for a fuser roll to reach a desired speed following the media substrate clearing the exit rollers.

4. The method of claim 3, further comprising partially expelling said media substrates from said duplex image forming device.

5. The method of claim 3, wherein said second gap is greater than said first gap.

6. The method of claim 3, wherein said second gap is substantially equal to said first gap.

7. The method of claim 3, wherein varying gaps between said media substrates as said media substrates are moved through said image forming device comprises varying said first gap, said second gap and a third gap between said first and second media substrates, said third gap being a distance between a new trailing edge of said first media substrate and a new leading edge said second media substrate.

8. The method of claim 7, wherein said third gap is smaller than said first gap.

9. The method of claim 7, wherein said third gap is the distance needed for toner patch sensing.

10. The method of claim 7, wherein said third gap is the distance needed for sensing the media sheets.

11. The method of claim 7, wherein said second gap is substantially equal to said first gap and said third gap is smaller than said first gap.

12. The method of claim 7, wherein varying gaps between said media substrates as said media substrates are moved through said image forming device comprises varying said first gap, said second gap, said third gap and a fourth gap between said second media substrate and a third media substrate, said fourth gap being a distance between a new trailing edge of said second media substrate and a leading edge said third media substrate.

13. The method of claim 12, wherein said fourth gap is the distance needed for toner patch sensing.

14. The method of claim 12, wherein said fourth gap is the distance needed to detect the sheets.

15. The method of claim 12, further comprising switching a transfer voltage of said image forming device from a two-sided sheet voltage to a one-sided sheet voltage, wherein said fourth gap is proportional to the time to switch said transfer voltage.

16. The method of claim 3, wherein the method comprises a two image sequence with two of said media substrates being within the image forming device at a time.

17. The method of claim 3, wherein the method comprises a three image sequence with three of said media substrates being within the image forming device at a time.

18. The method of claim 3, wherein the first gap is based upon the greater of a time necessary for the media substrate to clear exit rollers and enter the duplex path of the duplex image forming device and for the fuser roll to reach the desired speed, and a time for a media substrate to exit the duplex path.

19. The method of claim 18, wherein the second gap is based upon a time necessary for a media substrate to exit the duplex path of the duplex image forming device and for the fuser roll to reach the desired speed.

* * * * *